US009070337B2

(12) United States Patent
Misonou et al.

(10) Patent No.: US 9,070,337 B2
(45) Date of Patent: Jun. 30, 2015

(54) DISPLAY DEVICE WITH IMPROVED DRIVER FOR ARRAY OF CELLS CAPABLE OF STORING CHARGES

(75) Inventors: Toshiki Misonou, Ichihara (JP); Yasuhiko Yamagishi, Mobara (JP)

(73) Assignees: JAPAN DISPLAY INC., Tokyo (JP); PANASONIC LIQUID CRYSTAL DISPLAY CO., LTD, Hyogo-ken (JP)

( * ) Notice: Subject to any disclaimer, the term of this patent is extended or adjusted under 35 U.S.C. 154(b) by 230 days.

(21) Appl. No.: 13/177,724

(22) Filed: Jul. 7, 2011

(65) Prior Publication Data

US 2012/0007846 A1 Jan. 12, 2012

(30) Foreign Application Priority Data

Jul. 8, 2010 (JP) ..... 2010-156052

(51) Int. Cl.
*G09G 3/36* (2006.01)

(52) U.S. Cl.
CPC ..... *G09G 3/3666* (2013.01); *G09G 3/3614* (2013.01); *G09G 2300/0426* (2013.01); *G09G 2310/0213* (2013.01); *G09G 2330/06* (2013.01)

(58) Field of Classification Search
CPC ..... G09G 3/3685
USPC ..... 345/100
See application file for complete search history.

(56) References Cited

U.S. PATENT DOCUMENTS 4,779,086 A 10/1988 Kanno et al.
7,847,777 B2 * 12/2010 Choi ..... 345/98
7,944,458 B2 * 5/2011 Kwon et al. ..... 345/690
8,384,647 B2 * 2/2013 Yamagishi et al. ..... 345/99
8,384,649 B2 * 2/2013 Shang ..... 345/100
8,416,176 B2 * 4/2013 Lee et al. ..... 345/100

(Continued)

FOREIGN PATENT DOCUMENTS

JP 62-55625 3/1987
JP 09-033891 2/1997

(Continued)

OTHER PUBLICATIONS

Office Action in Japanese Application 2010-156052, dated Jan. 28, 2014, (3 pgs., in Japanese); [English language translation, 2 pgs.].

(Continued)

*Primary Examiner* — Chanh Nguyen
*Assistant Examiner* — Roy Rabindranath
(74) *Attorney, Agent, or Firm* — Lowe Hauptman & Ham, LLP

(57) ABSTRACT

Provided is a display device including a driver circuit for controlling supply of charges to an array of cells capable of storing the charges. In the driver circuit, a preceding electrically connecting part (SW221) controlled by a clock signal (CLK1) electrically connects an output signal line of a first circuit (211) having a positive polarity which is a potential higher than a reference potential and an output signal line of a second circuit (212) having a negative polarity which is a potential lower than the reference potential. After a predetermined time period has elapsed, a subsequent electrically connecting part (SW222) controlled by a clock signal (CLK2) electrically connects an output signal line of a third circuit (213) having the positive polarity and an output signal line of a fourth circuit (214) having the negative polarity.

4 Claims, 10 Drawing Sheets

(56) References Cited

U.S. PATENT DOCUMENTS

| | | | | |
|---|---|---|---|---|
| 2003/0151564 | A1 | 8/2003 | Yamashita et al. | |
| 2004/0263466 | A1 * | 12/2004 | Song et al. | 345/100 |
| 2009/0201283 | A1 | 8/2009 | Inokuchi et al. | |
| 2011/0164006 | A1 * | 7/2011 | Son et al. | 345/204 |

FOREIGN PATENT DOCUMENTS

| | | | |
|---|---|---|---|
| JP | H09-243998 | | 9/1997 |
| JP | H11-030975 | | 2/1999 |
| JP | 2003-122317 | | 4/2003 |
| JP | 2006-267999 | A | 10/2006 |
| JP | 2009-109881 | | 5/2009 |

OTHER PUBLICATIONS

Partial English language translation of Office Action in Japanese Application 2010-156052, dated May 27, 2014 (1 pg.).

* cited by examiner

DISPLAY DEVICE WITH IMPROVED DRIVER FOR ARRAY OF CELLS CAPABLE OF STORING CHARGES

CROSS-REFERENCE TO RELATED APPLICATION

The present application claims priority from Japanese application JP 2010-156052 filed on Jul. 8, 2010, the content of which is hereby incorporated by reference into this application.

BACKGROUND OF THE INVENTION

1. Field of the Invention

The present invention relates to a display device, and more specifically, to a display device using a driver circuit for controlling supply of charges to an array of cells capable of storing the charges, such as a liquid crystal display panel, an organic electroluminescence (EL) panel, and a dynamic random access memory (DRAM).

2. Description of the Related Art

Liquid crystal display devices are widely used as display devices for information communication terminals, such as computers, and television sets. The liquid crystal display device is a device in which the alignment of liquid crystal molecules which are sealed between two substrates is changed to change the transmittance of light, thereby controlling an image to be displayed. In order to change the alignment of the liquid crystal molecules, it is necessary to control charges to be supplied to electrodes provided on the substrates so as to change an electric field between the substrates. If the supplied charges have a biased polarity, the life of the liquid crystal panel is shortened. It is therefore common to control a display image by a so-called inversion driving method, in which driving is performed while inverting the polarity of the charges. Further, as described in Japanese Patent Application Laid-open Nos. 2003-122317, Sho 62-055625, and 2009-109881, aimed at suppressing power consumption required for charge inversion, there is known a driving method called charge sharing driving, in which output signals having different polarities are short-circuited at a predetermined timing to suppress the power consumption required for charge inversion.

SUMMARY OF THE INVENTION

The above-mentioned charge sharing driving plays an important role in saving power of the liquid crystal display device. It has been revealed, however, that electro magnetic interference (EMI) is generated from the liquid crystal display screen during the charge sharing driving. If the EMI increases, the operations of other electronic devices inside and outside the display device may be adversely affected. Particularly in a touch panel type liquid crystal display device, which operates as an input device when a finger or the like of the user contacts the screen, the electronic devices are arranged in proximity to the liquid crystal display screen and accordingly vulnerable to the influence of the EMI generated in the display screen. It is therefore necessary to prevent a malfunction caused by an erroneous recognition of position coordinates.

The present invention has been made in view of the above-mentioned circumstances, and it is therefore an object thereof to provide a driver circuit for controlling supply of charges to an array of cells capable of storing the charges, in which EMI generated in charge sharing driving of the charges can be reduced.

A display device according to one aspect of the present invention includes: an array of cells capable of storing charges; and a driver circuit for controlling supply of the charges to the array of the cells, the driver circuit including: a first circuit, a second circuit, a third circuit, and a fourth circuit, which are connected to a first output signal line, a second output signal line, a third output signal line, and a fourth output signal line, respectively, for supplying the charges to a plurality of different cells in the array, the first output signal line, the second output signal line, the third output signal line, and the fourth output signal line being sequentially adjacent to one another in the stated order; first preceding electrically connecting means for electrically connecting a signal line having a potential different from a potential of the first output signal line and the first output signal line to each other; and first subsequent electrically connecting means for electrically connecting, after the electrical connection made by the first preceding electrically connecting means, a signal line having a potential different from a potential of the fourth output signal line and the fourth output signal line to each other, in which: the first output signal line, the second output signal line, the third output signal line, and the fourth output signal line are each applied with one of a voltage having a positive polarity which is a potential higher than a reference potential and a voltage having a negative polarity which is a potential lower than the reference potential; the third output signal line is applied with a voltage having the same polarity as a polarity of the first output signal line; and the second output signal line and the fourth output signal line are each applied with a voltage having a polarity different from the polarity of the first output signal line.

Further, in the display device according to the present invention: the signal line having the potential different from the potential of the first output signal line may be the second output signal line, and the first preceding electrically connecting means may electrically connect the first output signal line and the second output signal line to each other; and the signal line having the potential different from the potential of the fourth output signal line may be the third output signal line, and the first subsequent electrically connecting means may electrically connect the fourth output signal line and the third output signal line to each other.

Further, in the display device according to the present invention: the driver circuit may further include: second preceding electrically connecting means, which is connected to the second output signal line, for making electrical connection at the same timing as a timing of the first preceding electrically connecting means; and second subsequent electrically connecting means, which is connected to the third output signal line, for making electrical connection at the same timing as a timing of the first subsequent electrically connecting means; the signal line having the potential different from the potential of the first output signal line and the signal line having the potential different from the potential of the fourth output signal line may be a common line as the same signal line; and the second preceding electrically connecting means and the second subsequent electrically connecting means may electrically connect the common line and the second output signal line and the third output signal line, respectively.

Further, in the display device according to the present invention: the driver circuit may further include: second preceding electrically connecting means, which is connected to the third output signal line, for making electrical connection at the same timing as a timing of the first preceding electrically connecting means; and second subsequent electrically connecting means, which is connected to the second output signal line, for making electrical connection at the same timing as a timing of the first subsequent electrically connecting means; the signal line having the potential different from the potential of the first output signal line and the signal line having the potential different from the potential of the fourth output signal line may be a common line as the same signal line; and the second preceding electrically connecting means and the second subsequent electrically connecting means may electrically connect the common line and the third output signal line and the second output signal line, respectively.

Further, a display device according to another aspect of the present invention includes: an array of cells capable of storing charges; and a driver circuit for controlling supply of the charges to the array of the cells, the driver circuit including a first circuit, a second circuit, a third circuit, and a fourth circuit for outputting output signals for supplying the charges to a plurality of different cells in the array, in which: the output signals are each one of a voltage having a positive polarity which is a potential higher than a reference potential and a voltage having a negative polarity which is a potential lower than the reference potential; the first circuit includes a first output signal line to which one of the output signals is applied; the second circuit includes a second output signal line to which another one of the output signals is applied, which has a polarity different from a polarity of the one of the output signals applied to the first output signal line; the third circuit includes a third output signal line to which still another one of the output signals is applied, which has the same polarity as the polarity of the one of the output signals applied to the first output signal line; the fourth circuit includes a fourth output signal line to which a further one of the output signals is applied, which has a polarity different from the polarity of the one of the output signals applied to the first output signal line; the driver circuit further includes: preceding electrically connecting means for electrically connecting a potential of the first output signal line and a potential of the second output signal line to each other; and subsequent electrically connecting means for electrically connecting, after the electrical connection made by the preceding electrically connecting means, a potential of the third output signal line and a potential of the fourth output signal line to each other; and the first output signal line, the second output signal line, the third output signal line, and the fourth output signal line are sequentially adjacent to one another in the stated order.

Further, in the display device according to the present invention: each of the first circuit, the second circuit, the third circuit, and the fourth circuit may include a switch which is connected to any one of the first output signal line, the second output signal line, the third output signal line, and the fourth output signal line; the switches may all be connected to a single common line; and each of the preceding electrically connecting means and the subsequent electrically connecting means may make electrical connection via the single common line.

Further, a display device according to still another aspect of the present invention includes: an array of cells capable of storing charges; and a driver circuit for controlling supply of the charges to the array of the cells, the driver circuit including a first circuit, a second circuit, a third circuit, and a fourth circuit for outputting output signals for supplying the charges to a plurality of different cells in the array, in which: the output signals are each one of a voltage having a positive polarity which is a potential higher than a reference potential and a voltage having a negative polarity which is a potential lower than the reference potential; the first circuit includes: a first output signal line to which one of the output signals is applied; and a first switch connected to the first output signal line; the second circuit includes: a second output signal line to which another one of the output signals is applied, which has the same polarity as a polarity of the one of the output signals applied to the first output signal line; and a second switch connected to the second output signal line; the third circuit includes: a third output signal line to which still another one of the output signals is applied, which has a polarity different from the polarity of the one of the output signals applied to the first output signal line; and a third switch connected to the third output signal line; the fourth circuit includes: a fourth output signal line to which a further one of the output signals is applied, which has a polarity different from the polarity of the one of the output signals applied to the first output signal line; and a fourth switch connected to the fourth output signal line; the first switch, the second switch, the third switch, and the fourth switch are all connected to a single common line; the driver circuit further includes: preceding electrically connecting means for electrically connecting a potential of the first output signal line and a potential of the third output signal line to each other via the single common line; and subsequent electrically connecting means for electrically connecting, after the electrical connection made by the preceding electrically connecting means, a potential of the second output signal line and a potential of the fourth output signal line to each other via the single common line; and the first output signal line, the second output signal line, the third output signal line, and the fourth output signal line are sequentially adjacent to one another in the stated order.

The array of cells capable of storing charges as used herein means, for example, a pixel electrode array for use in a liquid crystal display device, a light emitting element array for use in an organic electroluminescence (EL) display device, or a memory array for use in a dynamic random access memory (DRAM). Further, the reference potential as used herein is a potential indicating the destination of the potentials of the output signal lines of the respective circuits when the output signal lines are electrically connected to each other. The reference potential is, however, not necessarily a fixed potential, and may be an AC potential.

Further, the potential change in each of the first to fourth circuits is periodic, and the preceding electrically connecting means and the subsequent electrically connecting means make electrical connection repeatedly at the respective cycles of the potential changes. Alternatively, however, the electrical connection may be made at a fixed timing in the same cycle.

Further, in the display device according to the present invention, the driver circuit can further include: preceding clock signal generating means for generating a clock signal for controlling a timing of the electrical connection made by the preceding electrically connecting means; and subsequent clock signal generating means for generating a clock signal for controlling a timing of the electrical connection made by the subsequent electrically connecting means, the clock signal having the same cycle and a different phase from a cycle and a phase of the clock signal generated by the preceding clock signal generating means.

Further, the display device according to the present invention can be modified as a display device in which the cells are pixel electrodes for changing the alignment of liquid crystal and the first circuit, the second circuit, the third circuit, and the fourth circuit are a part of the driver circuit for use in a liquid crystal display device, each of which applies a voltage to the pixel electrodes to display an image. In other words, the driver circuit included in the display device according to the present invention can be used as a driver circuit for use in a liquid crystal display device.

Further, the display device according to the present invention can be modified as a display device in which the cells are light emitting elements and the first circuit, the second circuit, the third circuit, and the fourth circuit are a part of the driver circuit for use in an organic EL display device, each of which applies a voltage to the light emitting elements to display an image. In other words, the driver circuit included in the display device according to the present invention can be used as a driver circuit for use in an organic EL display device.

DETAILED DESCRIPTION OF THE INVENTION

Now, a brief summary of charge sharing driving of the present invention and a first embodiment of the present invention are described with reference to FIGS. 1 to 11.

Figure 1:
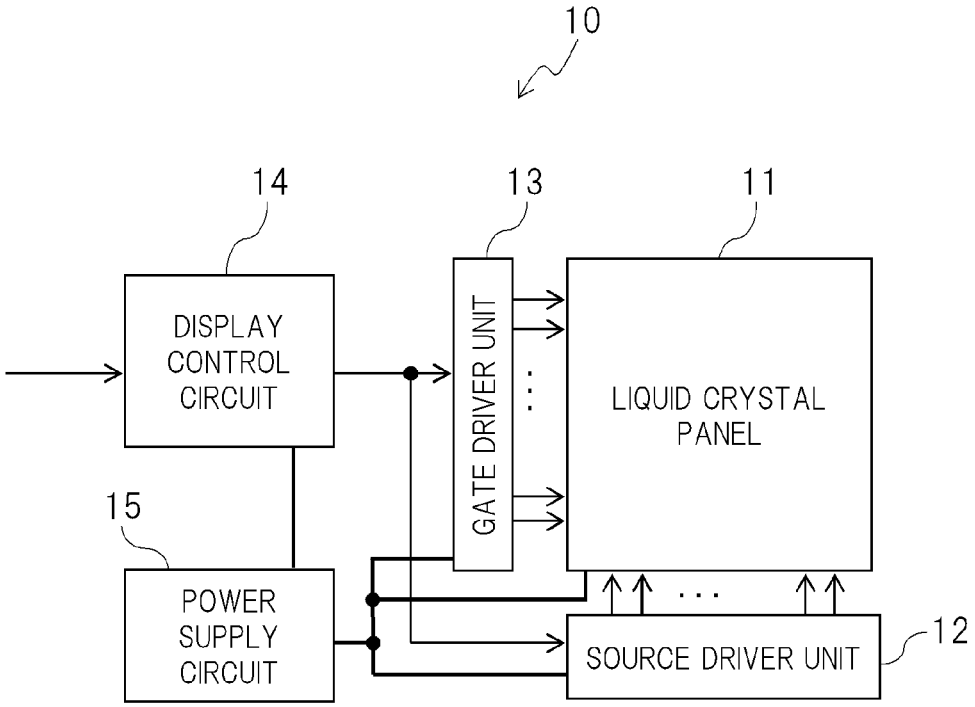
FIG. 1 is a diagram schematically illustrating a liquid crystal display device according to a first embodiment of the present invention.

FIG. 1 schematically illustrates a configuration of a thin film transistor (TFT) liquid crystal display device 10 including a driver circuit according to a first embodiment of the present invention. The liquid crystal display device 10 includes: (a) a liquid crystal panel 11 including TFTs, for operating the TFTs to display an image visually; (b) a source driver unit 12 for controlling a voltage to be applied to a drain terminal of the TFT included in the liquid crystal panel 11; (c) a gate driver unit 13 for controlling a voltage to be applied to a gate terminal of the TFT included in the liquid crystal panel 11; (d) a display control circuit 14 for receiving image data to be displayed and instructing operations of the source driver unit 12 and the gate driver unit 13; and (e) a power supply circuit 15 for supplying power to the liquid crystal panel 11, the source driver unit 12, the gate driver unit 13, and the display control circuit 14.

Figure 2:
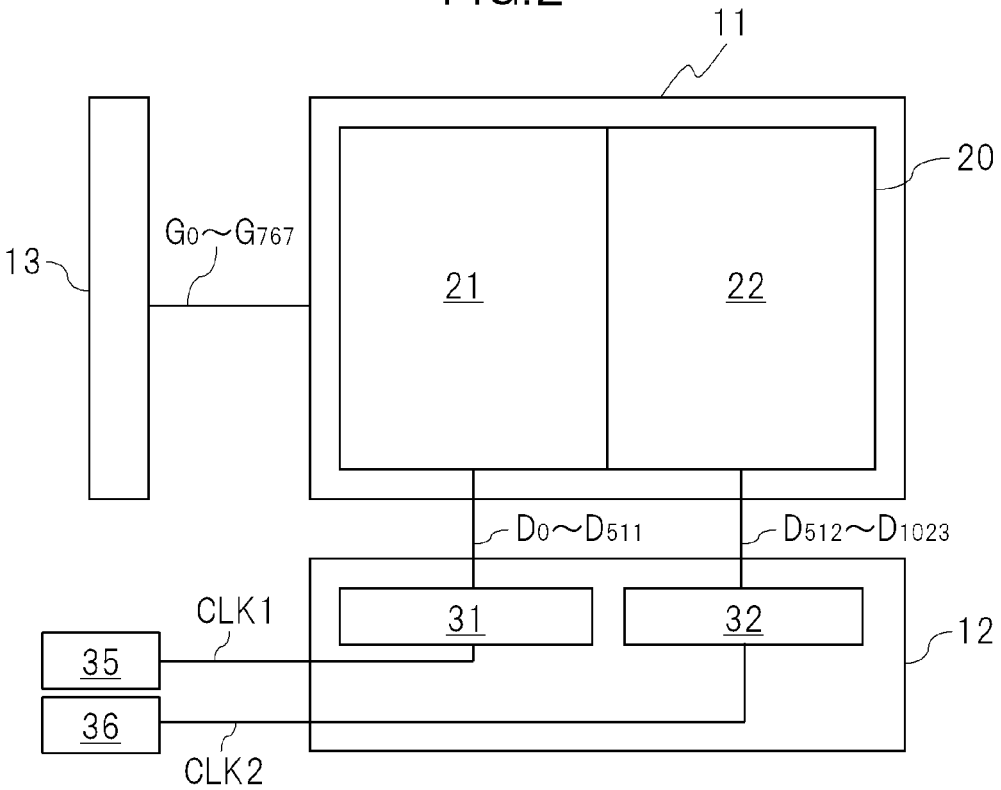
FIG. 2 is a diagram schematically illustrating a liquid crystal panel and driver units of FIG. 1.

FIG. 2 details configurations of the liquid crystal panel 11, the source driver unit 12, and the gate driver unit 13. The liquid crystal panel 11 is constituted by a TFT array substrate 20 having 1,024 horizontal pixels and 768 vertical pixels, and a color filter substrate, a polarizing plate, liquid crystal sealed between the substrates, and the like, all of which are not illustrated. Further, as illustrated in FIG. 2, the TFT array substrate 20 is constituted by a region 21 and a region 22. The region 21 is a region controlled by drain signals $D_0$ to $D_{511}$ serving as output signals from a first driving section 31 included in the source driver unit 12. The region 22 is a region controlled by drain signals $D_{512}$ to $D_{1023}$ serving as output signals from a second driving section 32 included in the source driver unit 12 similarly. To the first driving section 31, a clock signal CLK1 is input, which is generated by a first clock generation section 35. To the second driving section 32, a clock signal CLK2 is input, which is generated by a second clock generation section 36 and has a timing different from that of the clock signal CLK1. Further, the gate driver unit 13 outputs gate signals $G_0$ to $G_{767}$ of the entire liquid crystal panel 11.

Figure 3:
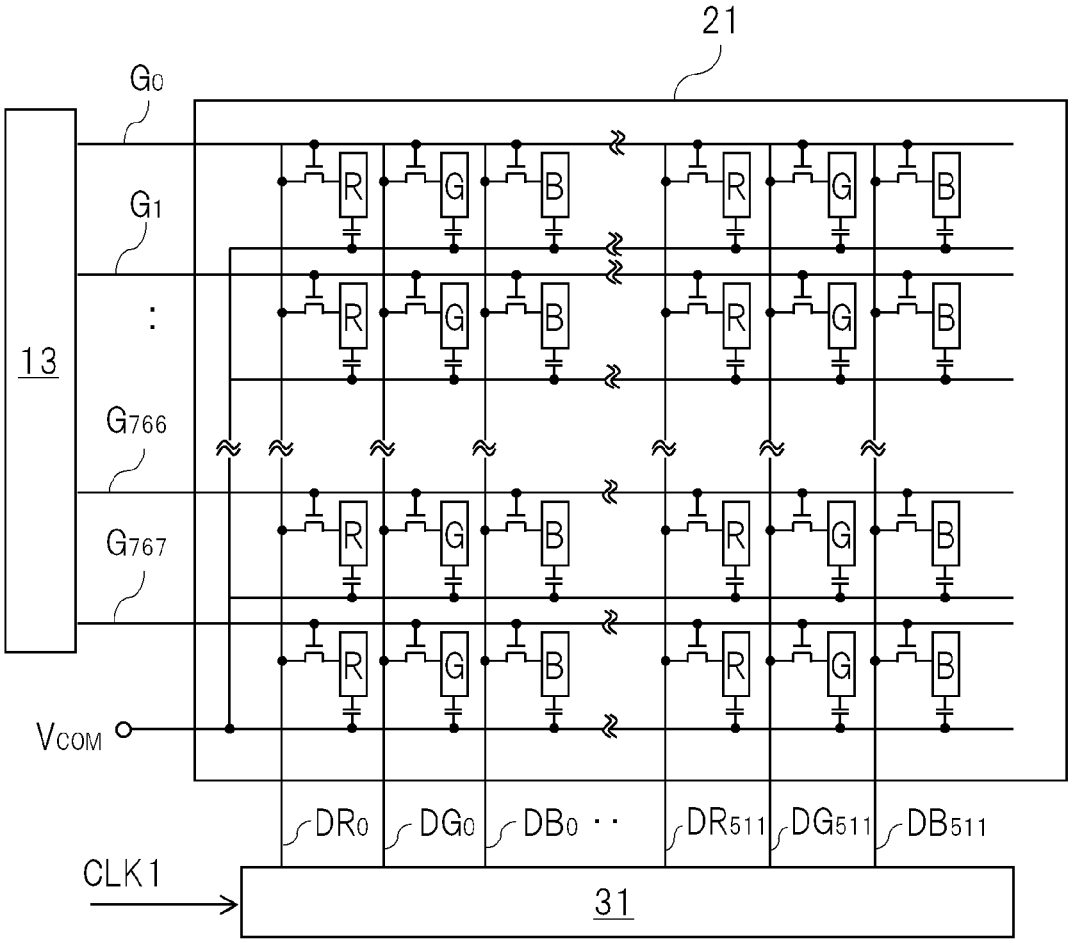
FIG. 3 is a diagram for describing display control of a region of FIG. 2.

FIG. 3 is a diagram for describing display control of the region 21 of the TFT array substrate 20 performed by the first driving section 31 and the gate driver unit 13. Referring to FIG. 3, each pixel is constituted by three kinds of transparent electrodes R, G, and B for controlling display of red, green, and blue, respectively, each of which is connected to a source signal of the TFT. To the drain sides of the TFTs, the drain signals $DR_0$ to $DR_{511}$. $DG_0$ to $DG_{511}$, and $DB_0$ to $DB_{511}$ are connected. To the gate sides of the TFTs, the gate signals $G_0$ to $G_{767}$ are connected. The first driving section 31 controls the drain signals $DR_0$ to $DR_{511}$. $DG_0$ to $DG_{511}$, and $DB_0$ to $DB_{511}$, and the gate driver unit 13 controls the gate signals $G_0$ to $G_{767}$. This way, display of a color corresponding to each pixel is controlled.

Figure 4:
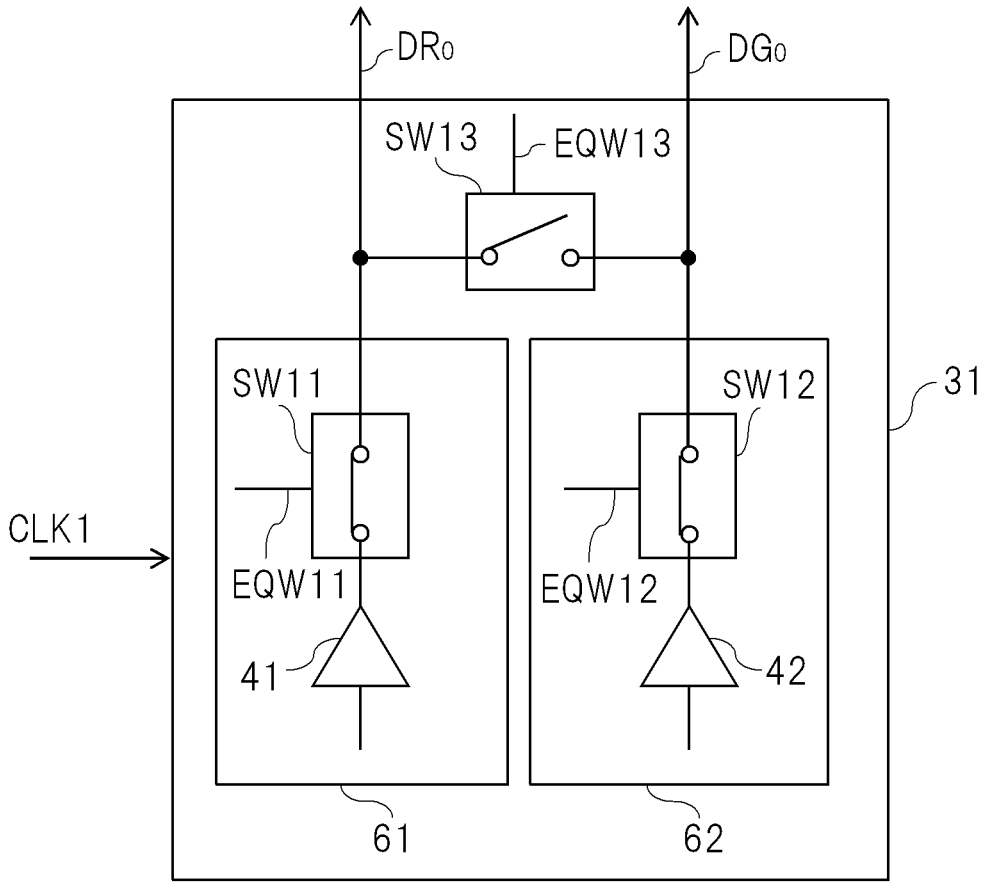
FIG. 4 is a diagram for describing control of drain signals performed by a driving section of FIG. 2.

FIG. 4 is a diagram for describing control of the drain signals $DR_0$ and $DG_0$ performed by the first driving section 31 of FIG. 3. Referring to FIG. 4, the first driving section 31 includes a $DR_0$ circuit 61 for outputting the drain signal $DR_0$ to be applied to the transparent electrode R, a $DG_0$ circuit 62 for outputting the drain signal $DG_0$ to be applied to the transparent electrode G, and a switch SW13 for electrically connecting the drain signals $DR_0$ and $DG_0$. The $DR_0$ circuit 61 and the $DG_0$ circuit 62 include amplifiers 41 and 42 and switches SW11 and SW12 for electrically disconnecting the amplifiers 41 and 42 from the drain signals $DR_0$ and $DG_0$, respectively.

The switches SW11, SW12, and SW13 are opened and closed by switch control signals EQW11, EQW12, and EQW13, respectively, which are controlled by the input clock signal CLK1. When the clock signal CLK1 is Low, all of the switch control signals EQW11, EQW12, and EQW13 are negative, and the switch SW11 and the switch SW12 are closed while the switch SW13 is opened. On the other hand, when the clock signal CLK1 is High, all of the switch control signals EQW11, EQW12, and EQW13 are active, and the switch SW11 and the switch SW12 are opened while the switch SW13 is closed. On this occasion, the drain signals $DR_0$ and $DG_0$ are controlled to be output by periodically inverting signals having different polarities, and further the drain signals $DR_0$ and $DG_0$ are controlled to be output at the same timing while having different polarities.

Figure 5:
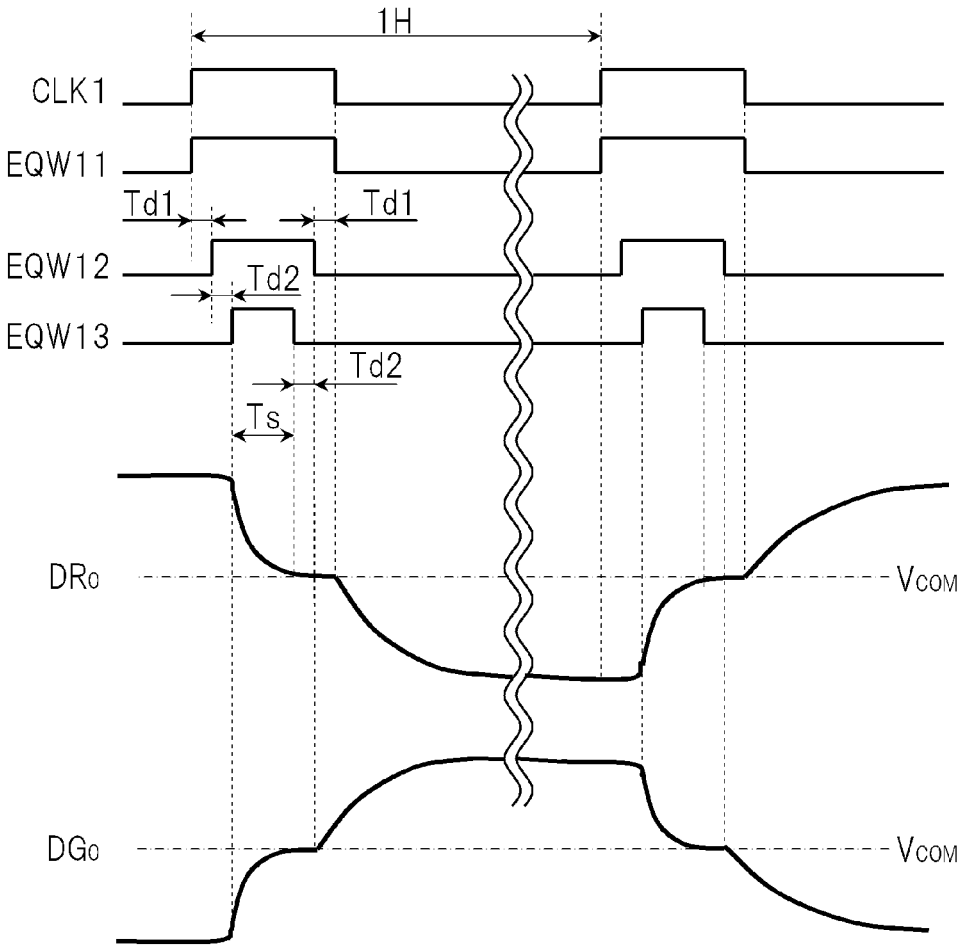
FIG. 5 is a timing chart illustrating temporal changes of respective signals illustrated in FIG. 4.

FIG. 5 is a timing chart illustrating operations of the clock signal CLK1, the switch control signals EQW11, EQW12, and EQW13, and the drain signals $DR_0$ and $DG_0$. Referring to the timing chart, first, when the clock signal CLK1 becomes High, the switch control signal EQW11 follows this operation to become active, which results that the switch SW11 is opened to electrically disconnect the amplifier 41 and the drain signal $DR_0$ from each other. After that, when a time period Td1 has elapsed, the switch control signal EQW12 becomes active and the switch SW12 is opened to electrically disconnect the amplifier 42 and the drain signal $DG_0$ from each other. Then, when a time period Td2 has elapsed, the switch control signal EQW13 becomes active and the switch SW13 is closed to electrically connect the drain signals $DR_0$ and $DG_0$ to each other. When the drain signals $DR_0$ and $DG_0$ are electrically connected, the positive (negative) polarity of the drain signal $DR_0$ and the negative (positive) polarity of the drain signal $DG_0$ are cancelled out, and the potentials of the drain signals $DR_0$ and $DG_0$ become close to a reference potential Vcom. When a time period Ts has elapsed, the switch control signal EQW13 becomes negative to electrically disconnect the drain signals $DR_0$ and $DG_0$ from each other.

After that, when another time period Td2 has elapsed, the switch control signal EQW12 becomes negative and the switch SW12 is closed to electrically connect the amplifier 42 and the drain signal $DG_0$ to each other, with the result that a positive (negative) voltage is applied to the drain signal $DG_0$. Then, when another time period Td1 has elapsed, the switch control signal EQW11 becomes negative and the switch SW11 is closed to electrically connect the amplifier 41 and the drain signal $DR_0$ to each other, with the result that a negative (positive) voltage is applied to the drain signal $DR_0$. Subsequently, the same operation is repeated in a cycle of horizontal synchronization (1H).

Figure 6:
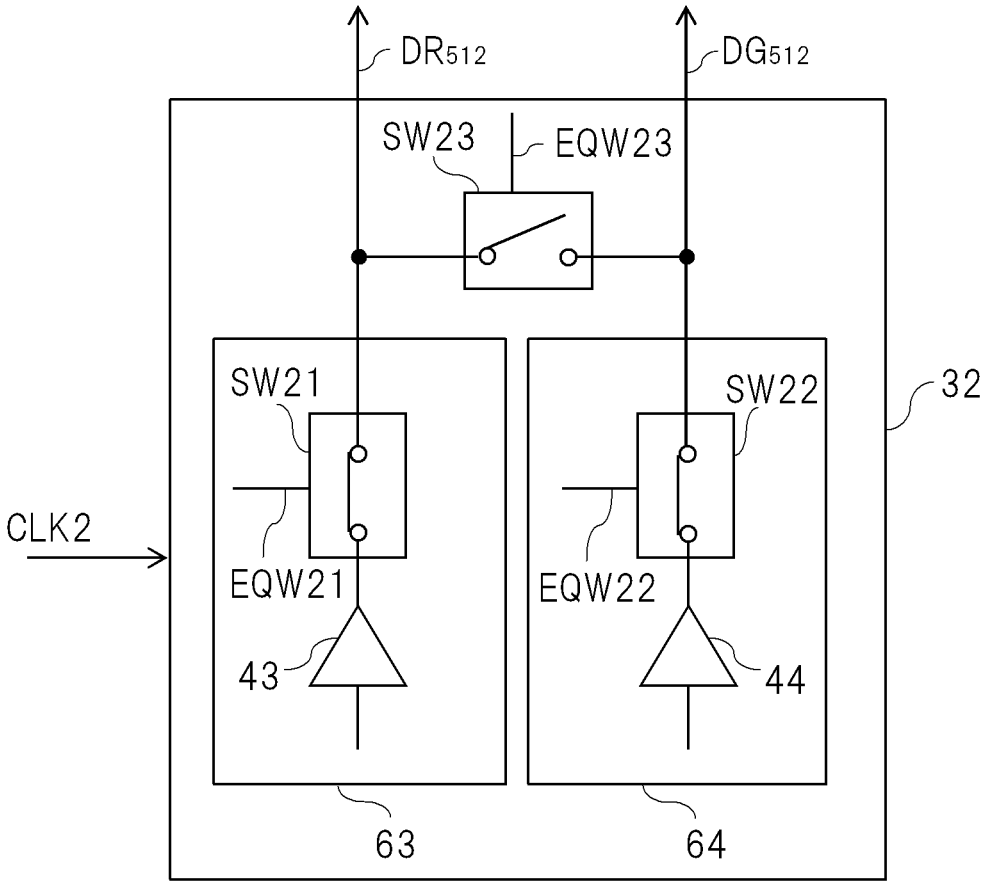
FIG. 6 is a diagram for describing control of drain signals performed by another driving section of FIG. 2.

FIG. 6 is a diagram for describing control of the drain signals $DR_{512}$ and $DG_{512}$ performed by the second driving section 32 of FIG. 3. Similarly to the configuration of the first driving section 31, the second driving section 32 includes a $DR_{512}$ circuit 63 for outputting the drain signal $DR_{512}$ to be applied to the transparent electrode R, a $DG_{512}$ circuit 64 for outputting the drain signal $DG_{512}$ to be applied to the transparent electrode G, and a switch SW23 for electrically connecting the drain signals $DR_{512}$ and $DG_{512}$. The $DR_{512}$ circuit 63 and the $DG_{512}$ circuit 64 include amplifiers 43 and 44 and switches SW21 and SW22 for electrically disconnecting the amplifiers 43 and 44 from the drain signals $DR_{512}$ and $DG_{512}$, respectively. The switches SW21, SW22, and SW23 are opened and closed by switch control signals EQW21, EQW22, and EQW23, respectively, which are controlled by the input clock signal CLK2. The signals operate in the same manner as in the timing chart of FIG. 5 except that the timing of the input clock signal CLK2 is different from the timing of the input clock signal CLK1.

Figure 7:
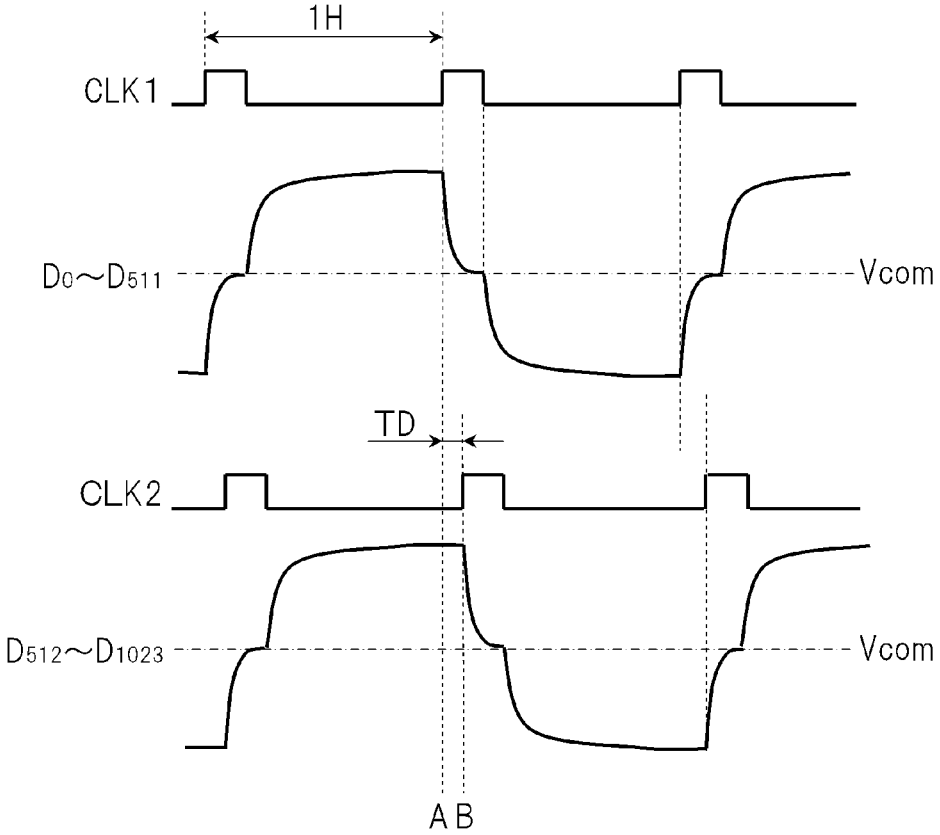
FIG. 7 is a timing chart illustrating temporal changes of outputs of clock signals and drain signals.
Figure 8:
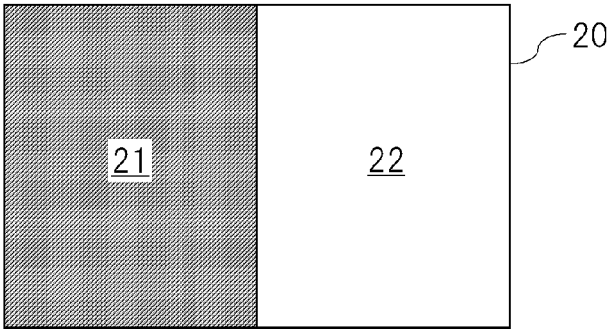
FIG. 8 is a diagram illustrating a region in which pixel electrodes related to electrical connection made at the timing A of FIG. 7 are disposed.
Figure 9:
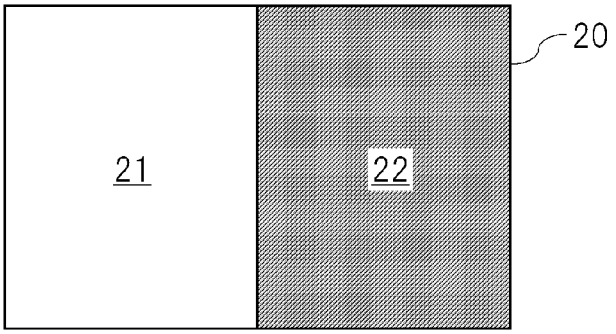
FIG. 9 is a diagram illustrating a region in which pixel electrodes related to electrical connection made at the timing B of FIG. 7 are disposed.

FIG. 7 illustrates timings of the drain signals $D_0$ to $D_{511}$, which are the outputs of the first driving section 31 to which the clock signal CLK1 is input, and timings of the drain signal $D_{512}$ to $D_{1023}$, which are the outputs of the second driving section 32 to which the clock signal CLK2 is input. Note that, the polarity of the drain signal is not taken into account in the timing chart of FIG. 7. Referring to FIG. 7, the timing of the input clock signal CLK2 is delayed by a time period TD from the input clock signal CLK1. Accordingly, timings of charge sharing, that is, timings of electrical connection (closing) of the switches SW13 and SW23 are also offset from each other by the time period TD. A timing at which the potentials of the drain signals $D_0$ to $D_{511}$ are moved to the reference potential Vcom and a timing at which the potentials of the drain signals $D_{512}$ to $D_{1023}$ are moved to the reference potential Vcom are also varied by the time period TD. In other words, at the timing A of FIG. 7, charge sharing is performed in the region 21 controlled by the first driving section 31 (indicated by the shaded area of FIG. 8), and then at the timing of B, charge sharing is performed in the region 22 controlled by the second driving section 32 (indicated by the shaded area of FIG. 9). This way, electro magnetic interference (EMI) to be generated can be reduced as compared to the case where the charge sharing is performed in the entire TFT array substrate 20 at the same time.

Figure 10:
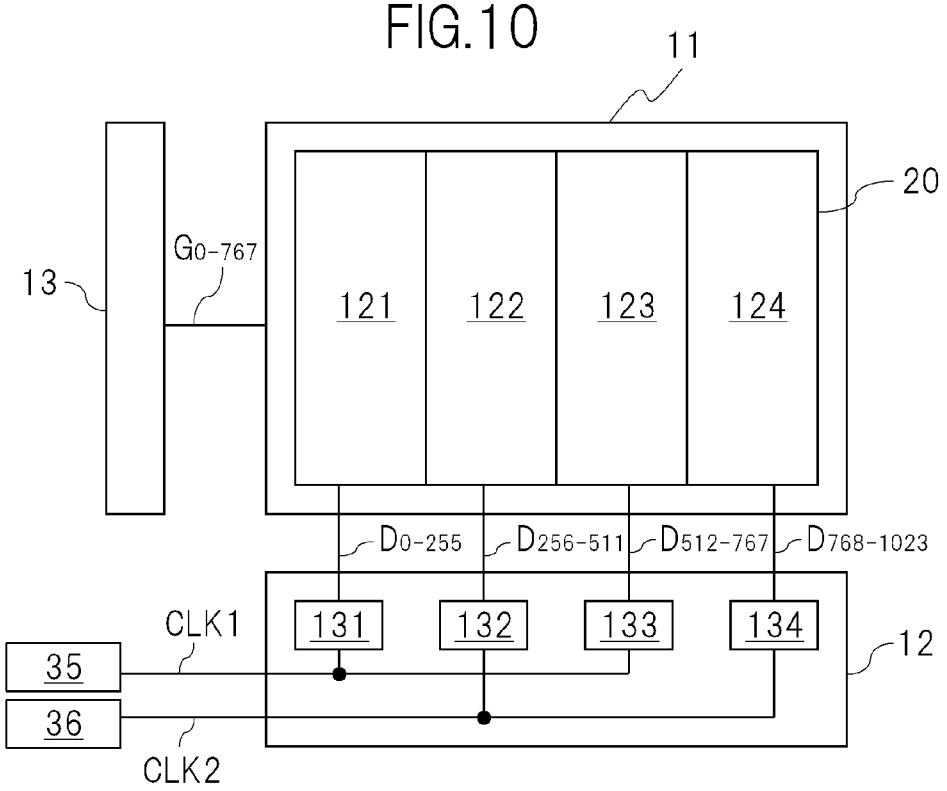
FIG. 10 is a diagram illustrating the case where the number of divided regions of a thin film transistor (TFT) array substrate is four in the first embodiment.

In the above-mentioned brief summary of the charge sharing driving, the TFT array substrate 20 is divided into the two regions 21 and 22. Alternatively, however, as illustrated in FIG. 10, the TFT array substrate 20 may be divided into four regions 121 to 124. In this case, as illustrated in FIG. 10, the clock signals CLK1 and CLK2 are each branched so as to be input alternately to a first driving section 131 to a fourth driving section 134 which control the drain signals D of the regions 121 to 124, respectively. This way, the EMI to be generated at the same time can be dispersed to reduce the EMI as a whole.

Further, even when the number of divided regions of the TFT array substrate 20 is increased to more than 4, the EMI can be reduced similarly.

Figure 11:
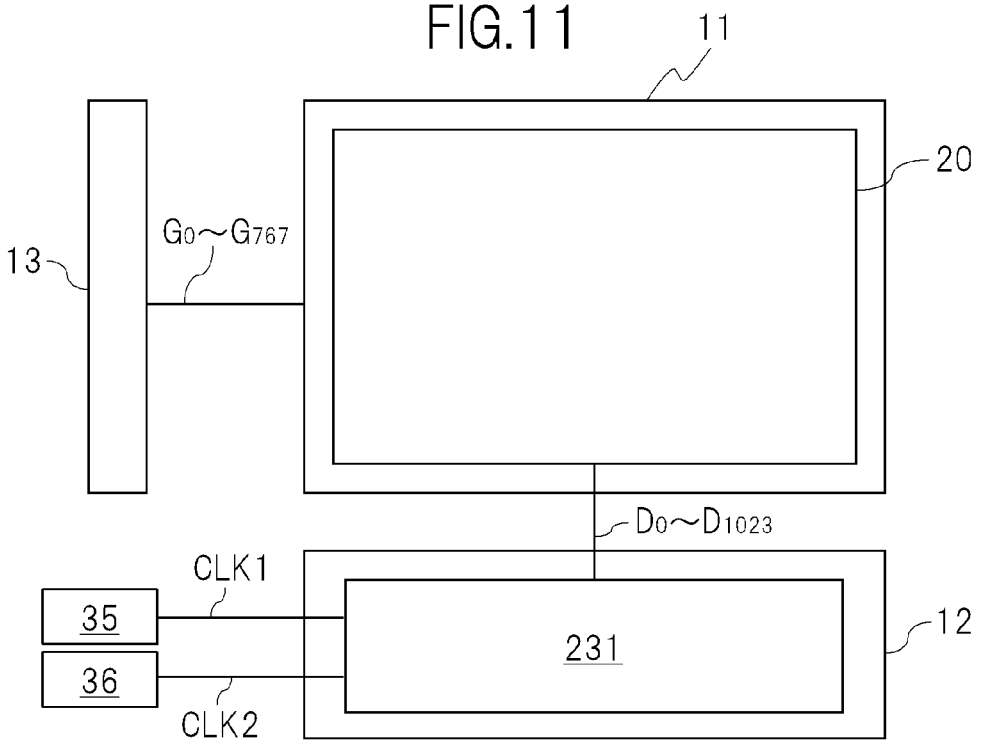
FIG. 11 is a diagram schematically illustrating a source driver unit using an integrated driving section, a gate driver unit, and a liquid crystal panel.
Figure 12:
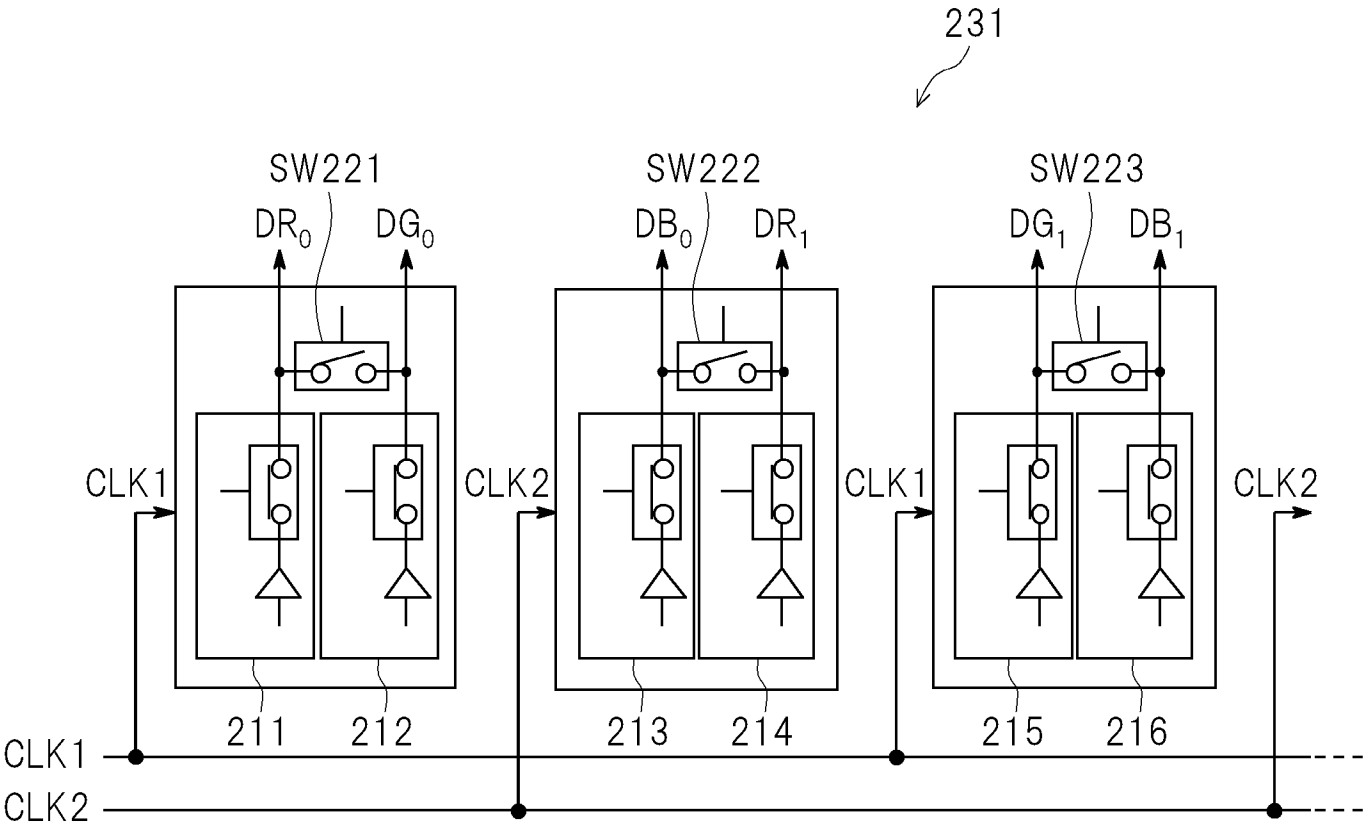
FIG. 12 is a diagram schematically illustrating a configuration of the driving section of FIG. 11.

FIG. 11 schematically illustrates the source driver unit 12, the liquid crystal panel 11, and the gate driver unit 13, the source driver unit 12 using an integrated driving section 231 to which both the clock signals CLK1 and CLK2 are input, with the increased number of divided regions. As illustrated in FIG. 12, the driving section 231 divides the TFT array substrate 20 in regions, each of which is divided by adjacent two lines (two signal lines). Referring to FIG. 12, the drain signals $DR_0$, $DG_0$, $DB_0$, $DR_1$, $DG_1$, and $DB_1$ are connected to a $DR_0$ circuit 211, a $DG_0$ circuit 212, a $DB_0$ circuit 213, a $DR_1$ circuit 214, a $DG_1$ circuit 215, and a $DB_1$ circuit 216, respectively, and also connected to a switch SW221 for electrically connecting the drain signals $DR_0$ and $DG_0$ to each other, a switch SW222 for electrically connecting the drain signals $DB_0$ and $DR_1$ to each other, and a switch SW223 for electrically connecting the drain signals $DG_1$ and $DB_1$ to each other. In other words, in FIG. 12, an output signal line of the drain signal $DR_0$ and an output signal line of the drain signal $DG_0$ form a pair and constitute a region. Further, an output signal line of the adjacent drain signal $DB_0$ and an output signal line of the adjacent drain signal $DR_1$ form a pair and constitute a region. In addition, the driving section 231 is divided into a plurality of unit driving sections, each of which is formed by a pair of two adjacent lines (e.g., a unit driving section constituted by the $DR_0$ circuit 211, the $DG_0$ circuit 212, and the switch SW221).

Also in the configuration of FIG. 12, similarly to FIG. 10, the input clock signals CLK1 and CLK2 are each branched so as to be input alternately to the plurality of unit driving sections, each of which is formed by a pair of two adjacent lines. This way, the EMI to be generated at the same time can be dispersed to reduce the EMI as a whole.

In the configuration of FIG. 12, the divided region of the TFT array substrate 20 is the minimum unit constituted by a pair of two adjacent lines. Therefore, noise to be generated, that is, the EMI can be cancelled out in the respective adjacent regions at a stage in which the level of EMI is small, which provides a remarkable effect of reducing the EMI in the entire display device.

Note that, if the source driver unit 12 illustrated in FIG. 11 is formed of a plurality of driver ICs, in the configuration of FIG. 12, a plurality of the above-mentioned unit driving sections are formed in each of the driver ICs.

Hereinafter, a second embodiment of the present invention is described with reference to FIG. 13.

A liquid crystal display device according to the second embodiment has the same configuration as that of the liquid crystal display device of the first embodiment except that the internal configuration of the driving section 231 of FIG. 11 is different, and hence description thereof is omitted. FIG. 13 is a diagram schematically illustrating an internal configuration of a driving section 331 corresponding to the driving section 231 of the first embodiment. Referring to FIG. 13, drain signals $DR_0$, $DG_0$, $DB_0$, $DR_1$, and $DG_1$ are connected to a $DR_0$ circuit 311, a $DG_0$ circuit 312, a $DB_0$ circuit 313, a $DR_1$ circuit 314, and a $DG_1$ circuit 315, and also connected to a common line CL via a switch SW321, a switch SW322, a switch SW323, a switch SW324, and a switch SW325, respectively. In other words, in FIG. 12 of the first embodiment, the switches SW221 to SW223 for setting the pair of two adjacent lines to the same potential, that is, for performing charge sharing driving are formed for each region, but in the configuration of FIG. 13, the switches SW321 to SW325 for performing charge sharing driving are formed for each line. Further, a switch control signal for controlling the switches SW321 to SW325 by the input clock signal CLK1 or CLK2 is also formed for each line. Therefore, the driving section 331 is divided into a plurality of unit driving sections, each of which is formed for each line (e.g., a unit driving section constituted by the $DR_0$ circuit 311 and the switch SW321).

Figure 13:
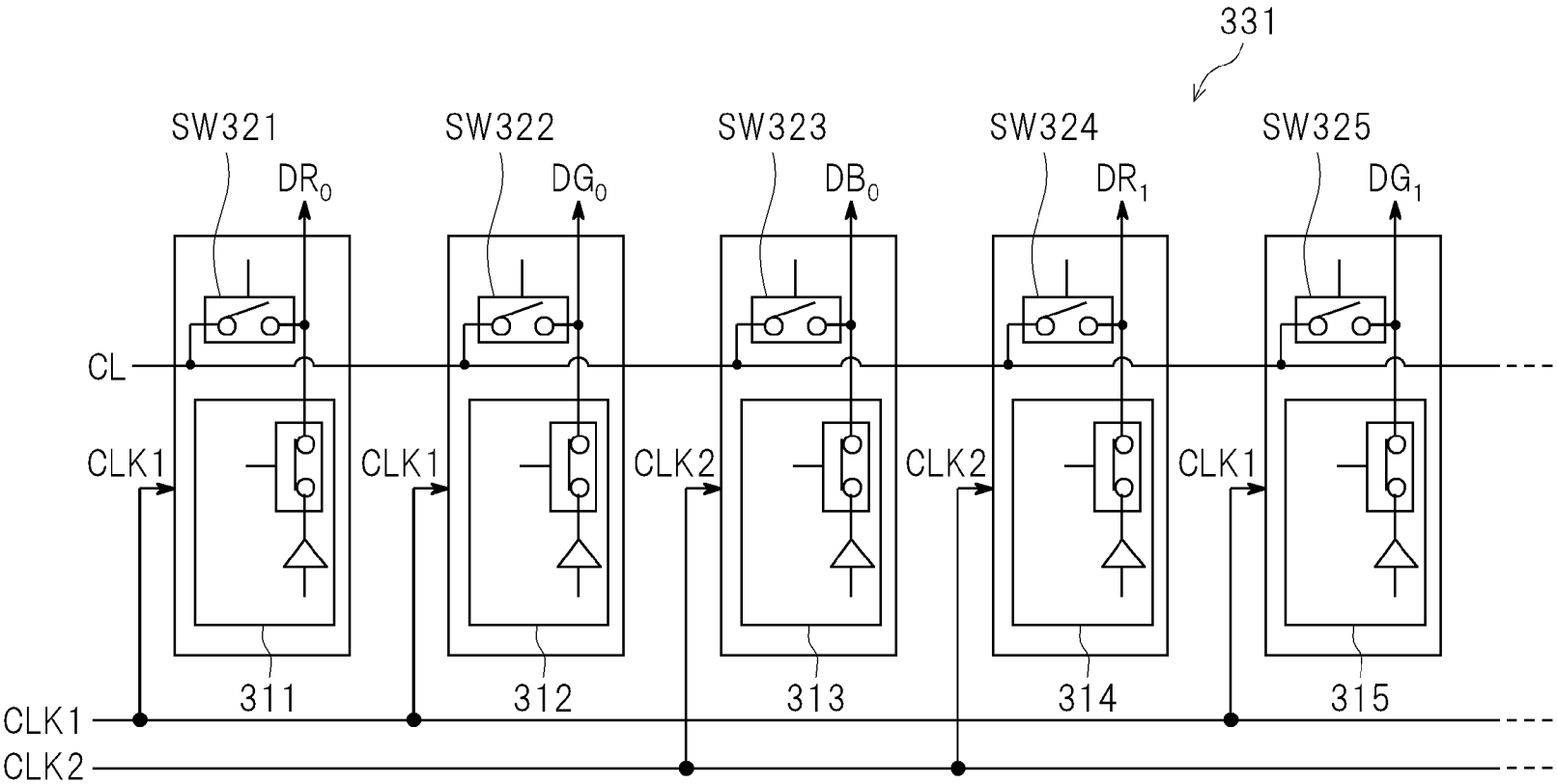
FIG. 13 is a diagram schematically illustrating a configuration of a driving section of a liquid crystal display device according to a second embodiment of the present invention.

Further, in FIG. 13, the switches SW321 to SW325 are each connected to the common line CL, which enables charge sharing to be performed on all the lines via the common line CL. It is desired that the common line CL be applied with a predetermined potential. For example, the reference potential Vcom may be applied to the common line CL. In addition, for example, the common line CL may be connected to a ground potential via a capacitor.

The input clock signals CLK1 and CLK2 having different clock timings are input alternately to the above-mentioned unit driving sections every pair of two adjacent lines. In other words, the input clock signal CLK1 is input to the unit driving section of the drain signal $DR_0$ and the unit driving section of the drain signal $DG_0$, whereas the input clock signal CLK2 having a different clock timing from that of the input clock signal CLK1 is input to the unit driving section of the drain signal $DB_0$ and the unit driving section of the drain signal $DR_1$. Subsequently, the input clock signals CLK1 and CLK2 are sequentially input alternately every pair of two adjacent lines in the same manner.

Also in the configuration of FIG. 13, the input clock signals CLK1 and CLK2 having different clock timings are alternately input so as to disperse the EMI to be generated at the same time, to thereby reduce the EMI as a whole.

Hereinafter, a third embodiment of the present invention is described with reference to FIG. 14.

A liquid crystal display device according to the third embodiment has the same configuration as that of the liquid crystal display device of the first embodiment except that the internal configuration of the driving section 231 of FIG. 11 is different, and hence description thereof is omitted. FIG. 14 is a diagram schematically illustrating an internal configuration of a driving section 431 corresponding to the driving section 231 of the first embodiment. Referring to FIG. 14, drain signals $DR_0$, $DG_0$, $DB_0$, and $DR_1$ are connected to a $DR_0$ circuit 411, a $DG_0$ circuit 412, a $DB_0$ circuit 413, and a $DR_1$ circuit 414, and also connected to a common line CL via a switch SW421, a switch SW422, a switch SW423, and a switch SW424, respectively. Further, the driving section 431 is divided into a plurality of unit driving sections, each of which is formed for each line (e.g., a unit driving section constituted by the $DR_0$ circuit 411 and the switch SW421). In this case, the configuration illustrated in FIG. 14 is different from FIG. 13 in that the input clock signals CLK1 and CLK2 are input alternately to the above-mentioned unit driving sections every line. In other words, the input clock signal CLK1 is input to the unit driving section of the drain signal $DR_0$, the input clock signal CLK2 is input to the unit driving section of the drain signal $DG_0$ adjacent thereto, and the input clock signal CLK1 is input to the unit driving section of the drain signal $DB_0$ adjacent thereto. Subsequently, the input clock signals CLK1 and CLK2 are sequentially input alternately every line in the same manner.

Figure 14:
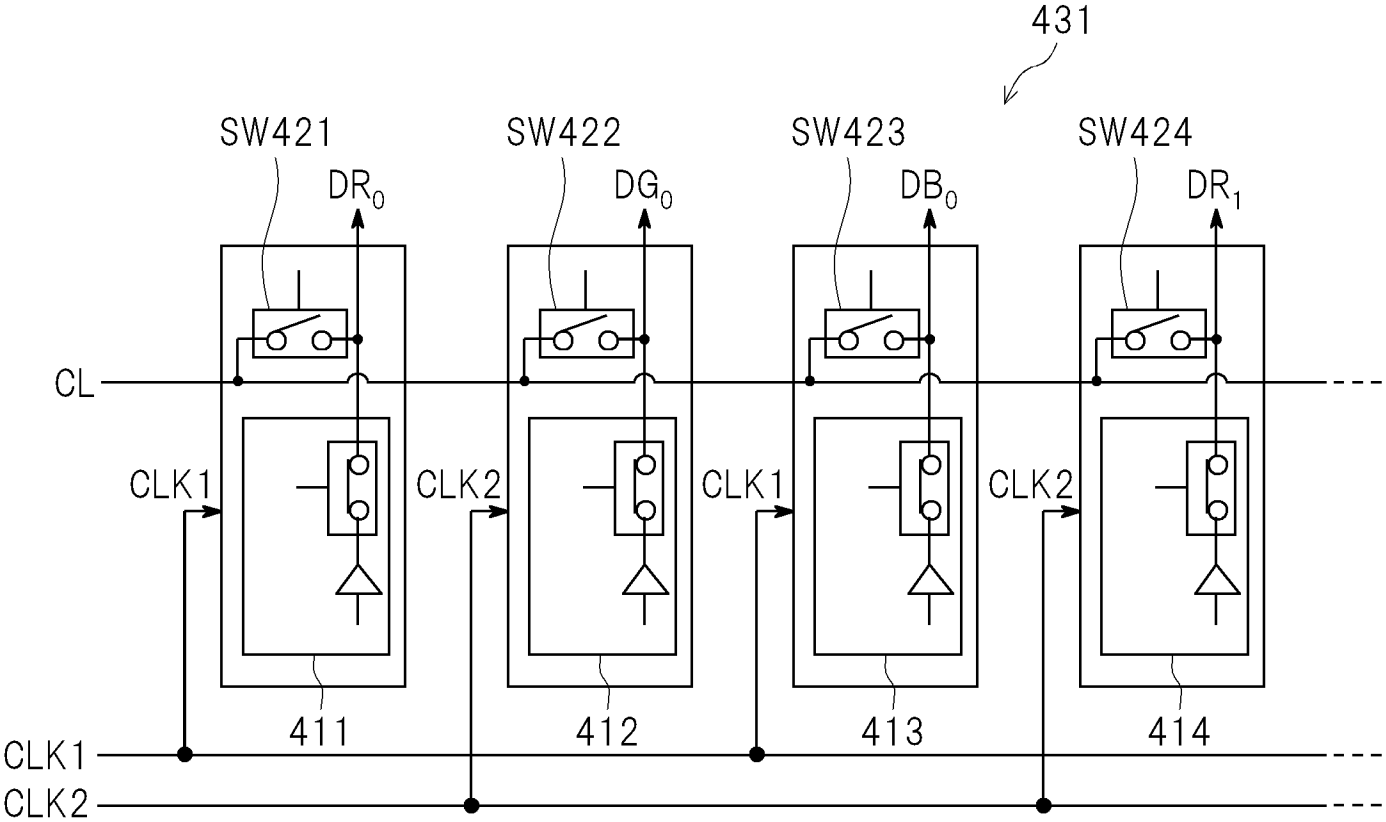
FIG. 14 is a diagram schematically illustrating a configuration of a driving section of a liquid crystal display device according to a third embodiment of the present invention.

Also in the configuration of FIG. 14, the input clock signals CLK1 and CLK2 having different clock timings are alternately input so as to disperse the EMI to be generated at the same time, to thereby reduce the EMI as a whole.

The configuration of FIG. 14 is particularly effective for a driving mode in which a signal having a potential higher than a reference potential and a signal having a potential lower than the reference potential switch places (are inverted) every two adjacent lines (two signal lines). In other words, in the drain signals ($DR_0$, $DB_0$, $DG_1$ . . . ) of the unit driving sections to which the clock signal CLK1 is input, the polarities of the potentials of the signal lines are inverted alternately. Similarly, in the drain signals ($DG_0$, $DR_1$, $DB_1$ . . . ) of the unit driving sections to which the clock signal CLK2 is input, the polarities of the potentials of the signal lines are inverted alternately. Note that, similarly to FIGS. 12 and 13, the configuration illustrated in FIG. 14 has the effect of reducing the EMI even in a driving mode in which a signal having a potential higher than a reference potential and a signal having a potential lower than the reference potential switch places (are inverted) every adjacent line.

As described above, the driver circuit according to the present invention controls the supply of charges to an array of cells capable of storing the charges in such a manner that, in the first circuit (211, 311, 411), a drain signal line and a signal line having a potential different from that of the drain signal line are electrically connected to each other under control of a timing of the clock signal CLK1, and with a delay, in the fourth circuit (214, 314, 414), a drain signal line and a signal line having a potential different from that of the drain signal line are electrically connected to each other under control of a timing of the clock signal CLK2. Therefore, the driver circuit according to the present invention is capable of dispersing the timings of the EMI to be generated in making electrical connection (charge sharing operation), to thereby reduce the influence thereof.

Note that, in the above-mentioned first to third embodiments, the driving mode using the fixed reference potential Vcom is employed. Alternatively, however, the present invention is also applicable to charge sharing in which an AC reference potential Vcom is used.

Further, the above-mentioned first to third embodiments are also applicable to another type of the inversion driving method for the charged polarity, such as a dot inversion driving method, a frame inversion driving method, a horizontal line inversion driving method, and a vertical line inversion driving method.

Further, the above-mentioned first to third embodiments have exemplified the display device which performs liquid crystal display using TFTs. However, the present invention is also applicable to a liquid crystal display device which performs display by another method having a charge sharing function, such as using thin film diodes (TFDs) or metal insulator metal (MIM) diodes.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

an array of cells capable of storing charges; and a driver circuit which controls supply of the charges to the array of the cells, the driver circuit comprising:

a first circuit, a second circuit, a third circuit, and a fourth circuit, which are connected to a first output signal line, a second output signal line, a third output signal line, and a fourth output signal line, respectively, and supply the charges to a plurality of different cells in the array, the first output signal line, the second output signal line, the third output signal line, and the fourth output signal line being sequentially adjacent to one another in this order;

a first preceding electrically connecting means which electrically connects the second output signal line having a potential different from a potential of the first output signal line and the first output signal line to each other; and a first subsequent electrically connecting means which electrically connects, at a timing after an electrical connection has been made by the first preceding electrically connecting means, the third output signal line having a potential different from a potential of the fourth output signal line and the fourth output signal line to each other, wherein the first output signal line, the second output signal line, the third output signal line, and the fourth output signal line are each applied with one of a voltage having a positive polarity which is a potential higher than a reference potential or a voltage having a negative polarity which is a potential lower than the reference potential, wherein the third output signal line is applied with a voltage having the same polarity as a polarity of the first output signal line, and wherein the second output signal line and the fourth output signal line are each applied with a voltage having a polarity different from the polarity of the first output signal line, and the first preceding electrically connecting means is configured to be controlled by a first clock signal which has a cycle of one horizontal synchronization period, the first subsequent electrically connecting means is configured to be controlled by a second clock signal which has a cycle of one horizontal synchronization period, and the second clock signal has a different phase from that of the first clock signal.

2. The display device according to claim 1, wherein the driver circuit further comprises:

a preceding clock signal generating means which generates the first clock signal controlling a timing of the electrical connection made by the preceding electrically connecting means; and a subsequent clock signal generating means which generates the second clock signal controlling a timing of the electrical connection made by the subsequent electrically connecting means.

3. A display device, comprising:

an array of cells capable of storing charges;

a driver circuit which controls supply of the charges to the array of the cells, the driver circuit comprising a first circuit, a second circuit, a third circuit, and a fourth circuit which outputs output signals supplying the charges to a plurality of different cells in the array, wherein the output signals are each one of a voltage having a positive polarity which is a potential higher than a reference potential or a voltage having a negative polarity which is a potential lower than the reference potential, wherein the first circuit includes a first output signal line to which one of the output signals is applied, wherein the second circuit includes a second output signal line to which another one of the output signals is applied, which has a polarity different from a polarity of the one of the output signals applied to the first output signal line, wherein the third circuit includes a third output signal line to which still another one of the output signals is applied, which has the same polarity as the polarity of the one of the output signals applied to the first output signal line, wherein the fourth circuit includes a fourth output signal line to which a further one of the output signals is applied, which has a polarity different from the polarity of the one of the output signals applied to the first output signal line, wherein the driver circuit further comprises:

a preceding electrically connecting means which electrically connects a potential of the first output signal line and a potential of the second output signal line to each other; and a subsequent electrically connecting means which electrically connects, at a timing after an electrical connection has been made by the preceding electrically connecting means, a potential of the third output signal line and a potential of the fourth output signal line to each other, and wherein the first output signal line, the second output signal line, the third output signal line, and the fourth output signal line are sequentially adjacent to one another in this order, the preceding electrically connecting means is configured to be controlled by a first clock signal which has a cycle of one horizontal synchronization period, the subsequent electrically connecting means is configured to be controlled by a second clock signal which has a cycle of one horizontal synchronization period, and the second clock signal has a different phase from that of the first clock signal.

4. The display device according to claim 3, wherein the driver circuit further comprises:

a preceding clock signal generating means which generates the first clock signal controlling a timing of the electrical connection made by the preceding electrically connecting means; and a subsequent clock signal generating means which generates the second clock signal controlling a timing of the electrical connection made by the subsequent electrically connecting means, the clock signal having a same cycle and a different phase from a cycle and a phase of the clock signal generated by the preceding clock signal generating means.

* * * * *